US012169084B2

(12) United States Patent
Yamaguchi et al.

(10) Patent No.: US 12,169,084 B2
(45) Date of Patent: Dec. 17, 2024

(54) COMPRESSOR UNIT AND REFRIGERATION APPARATUS

(71) Applicants: DAIKIN INDUSTRIES, LTD., Osaka (JP); DAIKIN EUROPE N.V., Ostend (BE)

(72) Inventors: Takahiro Yamaguchi, Ostend (BE); Yousuke Matsuda, Dubai (AE)

(73) Assignees: Daikin Industries, Ltd., Osaka (JP); Daikin Europe N.V., Ostend (BE)

( * ) Notice: Subject to any disclaimer, the term of this patent is extended or adjusted under 35 U.S.C. 154(b) by 289 days.

(21) Appl. No.: 17/685,710

(22) Filed: Mar. 3, 2022

(65) Prior Publication Data

US 2022/0268499 A1 Aug. 25, 2022

Related U.S. Application Data

(63) Continuation of application No. PCT/JP2019/034787, filed on Sep. 4, 2019.

(51) Int. Cl.
*F25B 41/24* (2021.01)
*F25B 49/02* (2006.01)

(52) U.S. Cl.
CPC ..... *F25B 41/24* (2021.01); *F25B 49/022* (2013.01); *F25B 2309/06* (2013.01); *F25B 2500/222* (2013.01); *F25B 2600/25* (2013.01)

(58) Field of Classification Search
CPC .. F25B 41/24; F25B 7/00; F25B 13/00; F25B 49/02; F25B 49/022; F25B 2309/06; F25B 2313/004; F25B 2600/25
See application file for complete search history.

(56) References Cited

U.S. PATENT DOCUMENTS

2003/0041607 A1 3/2003 Baumert et al.
2005/0132728 A1* 6/2005 Lifson ..... F25B 49/005 62/149

(Continued)

FOREIGN PATENT DOCUMENTS

EP 3081881 A1 * 10/2016 ..... F24F 1/08
EP 3 147 595 A1 3/2017

(Continued)

OTHER PUBLICATIONS

Extended European Search Report for European Application No. 19944361.5, dated Aug. 10, 2022.

(Continued)

*Primary Examiner* — Frantz F Jules
*Assistant Examiner* — Martha Tadesse
(74) *Attorney, Agent, or Firm* — Birch, Stewart, Kolasch & Birch, LLP

(57) ABSTRACT

A compressor unit includes a first case, a compressor, a connecting port, and a shutoff valve. The connecting port includes a first connecting port and a second connecting port. The shutoff valve includes a first shutoff valve and a second shutoff valve. A heat source heat exchanger is accommodated in a second case. A utilization heat exchanger is accommodated in a third case. The compressor unit is disposed inside a building. The first connecting port is connected to the heat source heat exchanger via a first connection piping. The second connecting port is connected to the utilization heat exchanger via a second connection piping. The first shutoff valve shuts off flow of a refrigerant between the first connecting port and the heat source heat exchanger. The second shutoff valve shuts off flow of the refrigerant between the second connecting port and the utilization heat exchanger.

16 Claims, 7 Drawing Sheets

(56) References Cited

U.S. PATENT DOCUMENTS

| | | | |
|---|---|---|---|
| 2016/0091235 | A1 | 3/2016 | Umehara |
| 2018/0128505 | A1 | 5/2018 | Baetens et al. |
| 2018/0209669 | A1 | 7/2018 | Baetens et al. |

FOREIGN PATENT DOCUMENTS

| | | | | |
|---|---|---|---|---|
| EP | 3361192 | A1 | | 8/2018 |
| FR | 2 825 789 | A1 | | 12/2002 |
| JP | 7-159010 | A | | 6/1995 |
| JP | H07159010 | A | * | 6/1995 |
| JP | 2009-204268 | A | | 9/2009 |
| JP | 2011-75117 | A | | 4/2011 |
| JP | 2011075117 | A | * | 4/2011 |
| JP | 2012-112622 | A | | 6/2012 |
| JP | 2012-137290 | A | | 7/2012 |
| JP | 2015-38390 | A | | 2/2015 |
| JP | 2015038390 | A | * | 2/2015 |
| JP | 2016-70519 | A | | 5/2016 |
| JP | 2018-511771 | A | | 4/2018 |
| JP | 2018-84410 | A | | 5/2018 |
| WO | WO 2006/052195 | A1 | | 5/2006 |
| WO | WO 2016/166988 | A1 | | 10/2016 |
| WO | WO 2018/147412 | A1 | | 8/2018 |
| WO | WO-2018147414 | A1 | * | 8/2018 ..... F24F 1/18 |
| WO | WO 2019/058464 | A1 | | 3/2019 |

OTHER PUBLICATIONS

International Search Report, issued in PCT/JP2019/034787, PCT/ISA/210, dated Oct. 29, 2019.

English translation of International Preliminary Report on Patentability and Written Opinion of the International Searching Authority for International Application No. PCT/JP2019/034787, dated Mar. 17, 2022.

* cited by examiner

COMPRESSOR UNIT AND REFRIGERATION APPARATUS

CROSS REFERENCE TO RELATED APPLICATIONS

This application is a Continuation of PCT International Application No. PCT/JP2019/034787, filed on Sep. 4, 2019, which is hereby expressly incorporated by reference into the present application.

TECHNICAL FIELD

The present disclosure relates to a compressor unit and a refrigeration apparatus including the compressor unit.

BACKGROUND ART

Patent Literature 1 (Japanese Patent Application Laid-Open Publication No. 2018-511771) discloses an air conditioner including a compressor unit, a heat source heat exchanger unit, and a utilization unit.

SUMMARY

A compressor unit according to one aspect includes a first case, a compressor, a connecting port, and a shutoff valve. The compressor is accommodated in the first case. The connecting port includes a first connecting port and a second connecting port. The shutoff valve includes a first shutoff valve and a second shutoff valve. The compressor, a heat source heat exchanger, and a utilization heat exchanger constitute a refrigerant cycle. The refrigerant cycle adopts the heat source heat exchanger as a heat source and causes circulation of a refrigerant. The heat source heat exchanger is accommodated in a second case provided separately from the first case. The utilization heat exchanger is accommodated in a third case provided separately from the first case. The compressor unit is disposed inside a building. The first connecting port is connected to the heat source heat exchanger via a first connection pipe. The second connecting port is connected to the utilization heat exchanger via a second connection pipe. The first shutoff valve shuts off movement of the refrigerant between the first connecting port and the heat source heat exchanger. The second shutoff valve shuts off movement of the refrigerant between the second connecting port and the utilization heat exchanger.

With this configuration, the shutoff valve can shut off a connection pipe extending from the compressor unit. Therefore, when the compressor unit has internal refrigerant leakage, leaking refrigerant is restrained from reaching outside the compressor unit.

DESCRIPTION OF EMBODIMENTS

First Embodiment

(1) OVERALL CONFIGURATION

Figure 1:
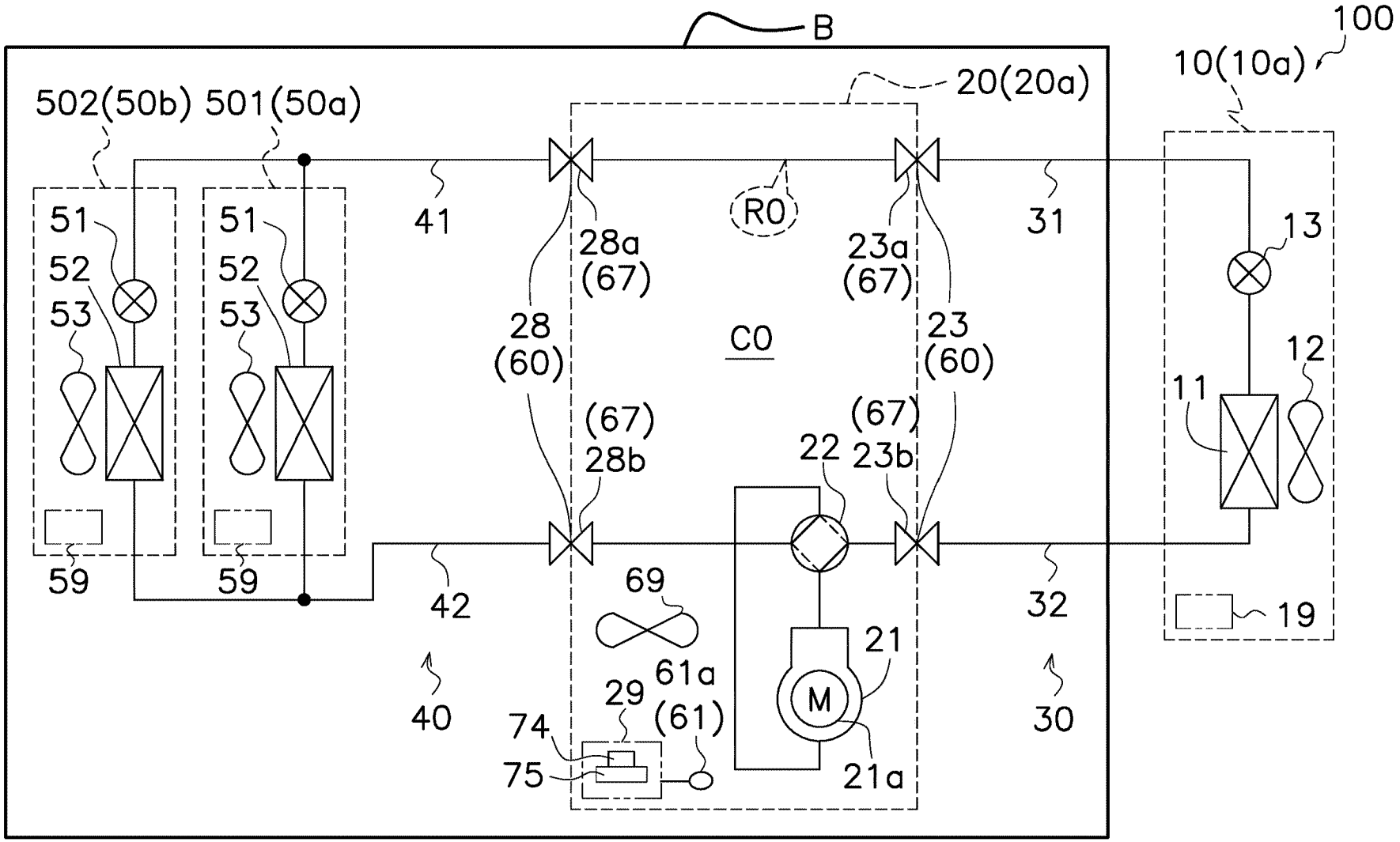
FIG. 1 is a circuit diagram of a refrigeration apparatus 100 according to a first embodiment.

FIG. 1 is a circuit diagram of a refrigeration apparatus 100 according to the first embodiment. The refrigeration apparatus 100 is typically exemplified by an air conditioner, but is not limited thereto. For example, the refrigeration apparatus 100 may be a refrigerator, a freezer, and a hot water supplier. The refrigeration apparatus 100 includes a heat source heat exchanger unit 10, a compressor unit 20, a first connection piping 30, utilization units 501 and 502, and a second connection piping 40. The refrigeration apparatus 100 handles a refrigerant R0. For example, the refrigerant R0 may be R32 or carbon dioxide.

(2) DETAILED CONFIGURATIONS (2-1) Heat Source Heat Exchanger Unit 10

The heat source heat exchanger unit 10 is disposed outside a building B. The heat source heat exchanger unit 10 includes a case 10*a*, a heat source heat exchanger 11, a heat source fan 12, a heat source heat exchanger unit expansion valve 13, and a heat source heat exchanger unit control unit 19.

(2-1-1) Case 10*a*

The case 10*a* accommodates components constituting the heat source heat exchanger unit 10. The case 10*a* is made of a metal or the like.

(2-1-2) Heat Source Heat Exchanger 11

The heat source heat exchanger 11 functions as a heat source. The heat source heat exchanger 11 exchanges heat between air outside the building B and the refrigerant R0. During cold heat utilization operation, the heat source heat exchanger 11 functions as a heat radiator (or a condenser) for the refrigerant R0. During hot heat utilization operation, the heat source heat exchanger 11 functions as a heat absorber (or an evaporator) for the refrigerant R0.

(2-1-3) Heat Source Fan 12

The heat source fan 12 generates an air flow to promote heat exchange in the heat source heat exchanger 11.

(2-1-4) Heat Source Heat Exchanger Unit Expansion Valve 13

The heat source heat exchanger unit expansion valve 13 decompresses the refrigerant R0. The heat source heat exchanger unit expansion valve 13 is configured to adjust its opening degree.

(2-1-5) Heat Source Heat Exchanger Unit Control Unit 19

The heat source heat exchanger unit control unit 19 includes a microcomputer and a memory. The heat source heat exchanger unit control unit 19 controls the heat source fan 12, the heat source heat exchanger unit expansion valve 13, and the like. The memory stores software for control of these components.

The heat source heat exchanger unit control unit 19 transmits and receives data and a command, via a communication line (not depicted), to and from each of a compressor unit control unit 29 and a utilization unit control unit 59, which will be described later.

(2-2) Compressor Unit 20

Figure 2:
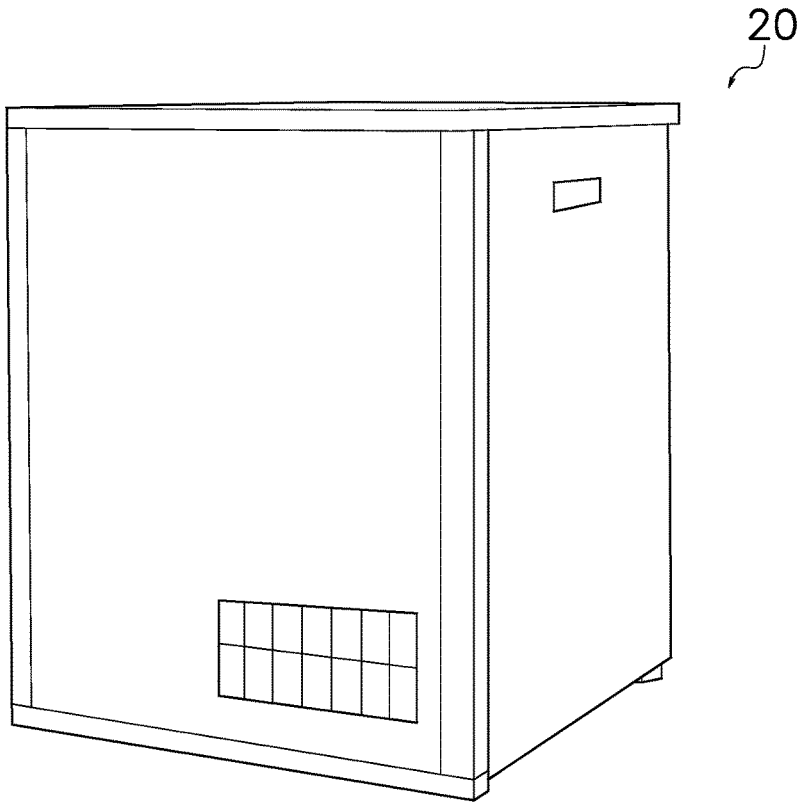
FIG. 2 is an external view of a compressor unit 20.

The compressor unit 20 has external appearance depicted in FIG. 2. As depicted in FIG. 1, the compressor unit 20 is disposed inside the building B. The compressor unit 20 includes a case 20*a*, a compressor 21, a four-way switching valve 22, a connecting port 60, a leakage detection sensor 61, the compressor unit control unit 29, and a fan 69.

(2-2-1) Case 20*a*

The case 20*a* accommodates components constituting the compressor unit 20. The case 20*a* is made of a metal or the like.

(2-2-2) Compressor 21

The compressor 21 compresses the refrigerant R0 that is sucked and is in a low-pressure gas state to obtain the refrigerant R0 in a high-pressure gas state. The compressor 21 includes a compressor motor 21*a*. The compressor motor 21*a* generates motive power necessary for compression.

The compressor 21 is a vibration source and may thus cause refrigerant leakage from the compressor 21 and a component adjacent thereto.

(2-2-3) Four-Way Switching Valve 22

The four-way switching valve 22 switches connection of a refrigerant circuit. During cold heat utilization operation, the four-way switching valve 22 achieves connection depicted by solid lines in FIG. 1. During hot heat utilization operation, the four-way switching valve 22 achieves connection depicted by broken lines in FIG. 1.

(2-2-4) Connecting Port 60

The connecting port 60 is provided for connection of a connection pipe. The connecting port 60 includes a first connecting port 23 and a second connecting port 28.

The first connecting port 23 is connected with the first connection piping 30 to be described later. The first connecting port 23 is provided with a first liquid side shutoff valve 23*a* and a first gas side shutoff valve 23*b*.

The second connecting port 28 is connected with the second connection piping 40 to be described later. The second connecting port 28 is provided with a second liquid side shutoff valve 28*a* and a second gas side shutoff valve 28*b*.

The first liquid side shutoff valve 23*a*, the first gas side shutoff valve 23*b*, the second liquid side shutoff valve 28*a*, and the second gas side shutoff valve 28*b* shut off a refrigerant flow path in response to a received command. The first liquid side shutoff valve 23*a*, the first gas side shutoff valve 23*b*, the second liquid side shutoff valve 28*a*, and the second gas side shutoff valve 28*b* may be collectively called a shutoff valve 67 in the present description.

(2-2-5) Leakage Detection Sensor 61

The leakage detection sensor 61 detects leakage of the refrigerant R0. The leakage detection sensor 61 is a refrigerant detection sensor 61*a* configured to detect presence of the refrigerant R0.

(2-2-6) Compressor Unit Control Unit 29

The compressor unit control unit 29 includes a circuit board, a microcomputer, a memory, an electrical component 74, and a heat sink 75, which are mounted on the circuit board. The electrical component 74 generates heat. The heat sink 75 effectively releases, into air, the heat generated by the electrical component 74.

The compressor unit control unit 29 controls the compressor motor 21*a*, the four-way switching valve 22, the first liquid side shutoff valve 23*a*, the first gas side shutoff valve 23*b*, the second liquid side shutoff valve 28*a*, the second gas side shutoff valve 28*b*, the fan 69, and the like. The compressor unit control unit 29 receives a signal from the leakage detection sensor 61. The memory stores software for control of these components.

The compressor unit control unit 29 transmits and receives data and a command, via a communication line (not depicted), to and from each of the heat source heat exchanger unit control unit 19 and the utilization unit control unit 59 to be described later.

(2-2-7) Fan 69

The fan 69 is configured to form a circulation air flow. The circulation air flow hits the circuit board to cool the microcomputer, the memory, the electrical component 74, and the heat sink 75 constituting the compressor unit control unit 29.

(2-3) First Connection Piping 30

The first connection piping 30 connects the heat source heat exchanger unit 10 and the compressor unit 20. The first connection piping 30 includes a first liquid connection pipe 31 and a first gas connection pipe 32.

(2-3-1) First Liquid Connection Pipe 31

The first liquid connection pipe 31 connects the heat source heat exchanger unit 10 and the first liquid side shutoff valve 23*a*. The first liquid connection pipe 31 guides the refrigerant R0 principally in a high-pressure liquid state or in a low-pressure gas-liquid two-phase state.

(2-3-2) First Gas Connection Pipe 32

The first gas connection pipe 32 connects the heat source heat exchanger unit 10 and the first gas side shutoff valve 23*b*. The first gas connection pipe 32 guides the refrigerant R0 principally in the high-pressure gas state or in the low-pressure gas state.

(2-4) Utilization Units 501 and 502

Figure 3:
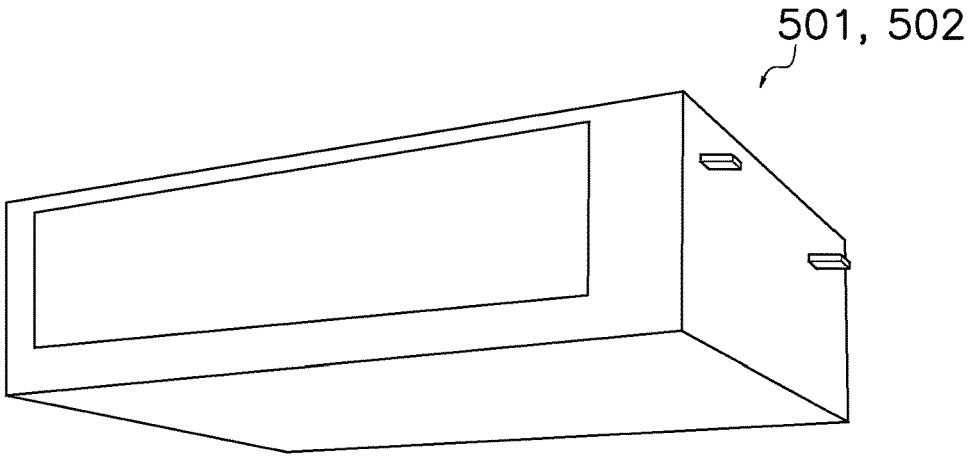
FIG. 3 is an external view of indoor units 501 and 502.

The utilization units 501 and 502 each have external appearance depicted in FIG. 3. As depicted in FIG. 1, the utilization units 501 and 502 are disposed inside the building B. The utilization unit 501 and the utilization unit 502 are configured identically to each other.

The following description will thus be made to only the utilization unit 501 without repetitively describing the utilization unit 502. The utilization unit 501 includes a case 50*a*, a utilization unit expansion valve 51, a utilization heat exchanger 52, a utilization fan 53, and the utilization unit control unit 59.

(2-4-1) Case 50*a*

The case 50*a* accommodates components constituting the utilization unit 501.

(2-4-2) Utilization Unit Expansion Valve 51

The utilization unit expansion valve 51 decompresses the refrigerant R0. The utilization unit expansion valve 51 controls a flow rate of the refrigerant R0. The utilization unit expansion valve 51 is configured to adjust its opening degree.

(2-4-3) Utilization Heat Exchanger 52

The utilization heat exchanger 52 provides a user with low temperature heat or high temperature heat. The utilization heat exchanger 52 exchanges heat between air inside the building B and the refrigerant R0. During cold heat utilization operation, the utilization heat exchanger 52 functions as a heat absorber (or an evaporator) for the refrigerant R0. During hot heat utilization operation, the utilization heat exchanger 52 functions as heat radiator (or a condenser) for the refrigerant R0.

(2-4-4) Utilization Fan 53

The utilization fan 53 generates an air flow to promote heat exchange in the utilization heat exchanger 52.

(2-4-5) Utilization Unit Control Unit 59

The utilization unit control unit 59 includes a microcomputer and a memory. The utilization unit control unit 59 controls the utilization unit expansion valve 51, the utilization fan 53, and the like. The memory stores software for control of these components.

The utilization unit control unit 59 transmits and receives data and a command, via a communication line (not depicted), to and from each of the heat source heat exchanger unit control unit 19 and the compressor unit control unit 29.

(2-5) Second Connection Piping 40

The second connection piping 40 connects the compressor unit 20 and the utilization units 501 and 502. The second connection piping 40 includes a second liquid connection pipe 41 and a second gas connection pipe 42.

(2-5-1) Second Liquid Connection Pipe 41

The second liquid connection pipe 41 connects the second liquid side shutoff valve 28*a* and the utilization units 501 and 502. The second liquid connection pipe 41 guides the refrigerant R0 principally in the high-pressure liquid state or in the low-pressure gas-liquid two-phase state.

(2-5-2) Second Gas Connection Pipe 42

The second gas connection pipe 42 connects the second gas side shutoff valve 28*b* and the utilization units 501 and 502. The second gas connection pipe 42 guides the refrigerant R0 principally in the high-pressure gas state or in the low-pressure gas state.

(3) CONFIGURATION OF REFRIGERANT CIRCUIT

The refrigeration apparatus 100 entirely constitutes a single refrigerant cycle C0. The refrigerant cycle C0 causes circulation of the refrigerant R0. The refrigerant cycle C0 adopts the heat source heat exchanger 11 as a heat source. The refrigerant cycle C0 is constituted by components such as the compressor 21, the four-way switching valve 22, the first gas side shutoff valve 23*b*, the heat source heat exchanger 11, the heat source heat exchanger unit expansion valve 13, the first liquid side shutoff valve 23*a*, the second liquid side shutoff valve 28*a*, the utilization unit expansion valve 51, the utilization heat exchanger 52, and the second gas side shutoff valve 28*b*.

(4) OPERATION OF REFRIGERATION APPARATUS 100

Hereinafter, assume that the refrigerant R0 has reaction accompanied with phase transition (condensation or evaporation) during heat exchange. The refrigerant R0 is not limited to these in terms of its state, and may have reaction accompanied with no phase transition.

(4-1) Cold Heat Utilization Operation

The compressor 21 discharges the refrigerant R0 in the high-pressure gas state. The refrigerant R0 in the high-pressure gas state passes through the four-way switching valve 22 and the first gas side shutoff valve 23*b* to reach the heat source heat exchanger 11. The refrigerant R0 condenses to come into the high-pressure liquid state in the heat source heat exchanger 11. The refrigerant R0 in the high-pressure liquid state reaches the heat source heat exchanger unit expansion valve 13. At the heat source heat exchanger unit expansion valve 13, the refrigerant R0 is decompressed to come into the low-pressure gas-liquid two-phase state. The refrigerant R0 in the low-pressure gas-liquid two-phase state passes through the first liquid side shutoff valve 23*a* and the second liquid side shutoff valve 28*a* to reach the utilization unit expansion valve 51. The refrigerant R0 is further decompressed at the utilization unit expansion valve 51. The refrigerant R0 reaches the utilization heat exchanger 52. The refrigerant R0 evaporates to come into the low-pressure gas state at the utilization heat exchanger 52. The refrigerant R0 provides the user with low temperature heat in this process.

The refrigerant R0 in the low-pressure gas state passes through the second gas side shutoff valve 28*b* and the four-way switching valve 22 to reach the compressor 21. The compressor 21 sucks the refrigerant R0 in the low-pressure gas state.

(4-2) Hot Heat Utilization Operation

The compressor 21 discharges the refrigerant R0 in the high-pressure gas state. The refrigerant R0 in the high-pressure gas state passes through the four-way switching valve 22 and the second gas side shutoff valve 28*b* to reach the utilization heat exchanger 52. The refrigerant R0 condenses to come into the high-pressure liquid state at the utilization heat exchanger 52. The refrigerant R0 provides the user with high temperature heat in this process. The refrigerant R0 in the high-pressure liquid state reaches the utilization unit expansion valve 51. At the utilization unit expansion valve 51, the refrigerant R0 is decompressed to come into the low-pressure gas-liquid two-phase state. The refrigerant R0 in the low-pressure gas-liquid two-phase state passes through the second liquid side shutoff valve 28*a* and the first liquid side shutoff valve 23*a* to reach the heat source heat exchanger unit expansion valve 13. The refrigerant R0 is further decompressed at the heat source heat exchanger unit expansion valve 13. The refrigerant R0 reaches the heat source heat exchanger 11. The refrigerant R0 evaporates to come into the low-pressure gas state in the heat source heat exchanger 11. The refrigerant R0 in the low-pressure gas state passes through the first gas side shutoff valve 23*b* and the four-way switching valve 22 to reach the compressor 21. The compressor 21 sucks the refrigerant R0 in the low-pressure gas state.

(4-3) Operation Upon Refrigerant Leakage

When refrigerant leakage occurs in the compressor unit 20, the refrigerant detection sensor 61*a* detects the refrigerant R0. The refrigerant detection sensor 61*a* outputs an output signal, which is then received by a microcomputer of the compressor unit 20. The microcomputer transmits, to the shutoff valve 67, a command (or a control signal) for shutoff. The shutoff valve 67 having received the command closes the refrigerant flow path.

(5) CHARACTERISTICS (5-1)

The shutoff valve 67 can shut off the first connection piping 30 and the second connection piping 40 extending from the compressor unit 20. When the refrigerant R0 leaks in the compressor unit 20, this configuration can thus inhibit the leaking refrigerant R0 from reaching outside the compressor unit 20.

The compressor unit 20 and the heat source heat exchanger unit 10 are constituted as separate units in the present configuration. The refrigeration apparatus 100 accordingly includes the first connection piping 30 (the first liquid connection pipe 31 and the first gas connection pipe 32) connecting the compressor unit 20 and the heat source heat exchanger unit 10. The refrigeration apparatus 100 including the first connection piping 30 having a large length uses a more refrigerant in comparison to a refrigeration apparatus including the compressor 21 and the heat source heat exchanger 11 belonging to an identical unit. Also in this case, the shutoff valve 67 thus provided can inhibit spread of refrigerant leakage.

(5-2)

The leakage detection sensor 61 detects leakage of the refrigerant R0. The shutoff valve 67 can thus be shut off in accordance with an output signal from the leakage detection sensor 61.

The leakage detection sensor 61 is the refrigerant detection sensor 61*a*. This configuration accordingly achieves direct detection of the leaking refrigerant R0.

(5-3)

The compressor unit control unit 29 automatically closes the shutoff valve 67 when leakage of the refrigerant R0 is detected. This enables quick inhibition of refrigerant leakage. This configuration can also contain the refrigerant R0 in the first connection piping 30 or the heat source heat exchanger unit 10 to inhibit spread of refrigerant leakage.

(5-4)

The compressor unit control unit 29 is cooled by the circulation air flow formed by the fan 69. This enables effective release of heat generated by the electrical component 74 with the circulation air flow.

(6) MODIFICATION EXAMPLES

(6-1) Modification Example 1A

Figure 4:
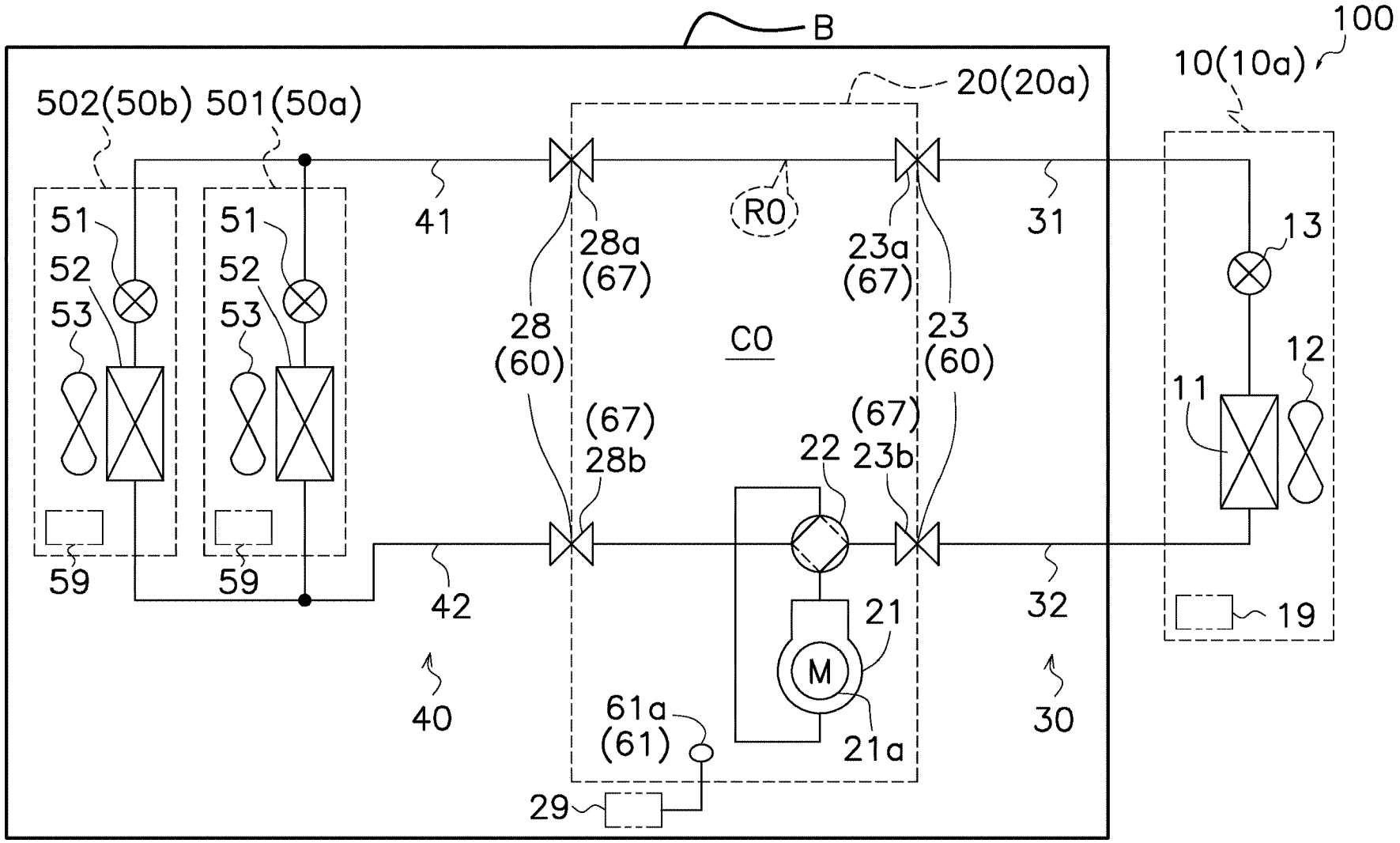
FIG. 4 is a circuit diagram of the refrigeration apparatus 100 according to a modification example 1A of the first embodiment.

FIG. 4 depicts the refrigeration apparatus 100 according to the modification example 1A of the first embodiment. Unlike the above embodiment, the compressor unit control unit 29 in the refrigeration apparatus 100 is disposed outside the case 20*a*.

This configuration enables effective release of heat generated by the circuit board constituting the compressor unit control unit 29.

(6-2) Modification Example 1B

Figure 5:
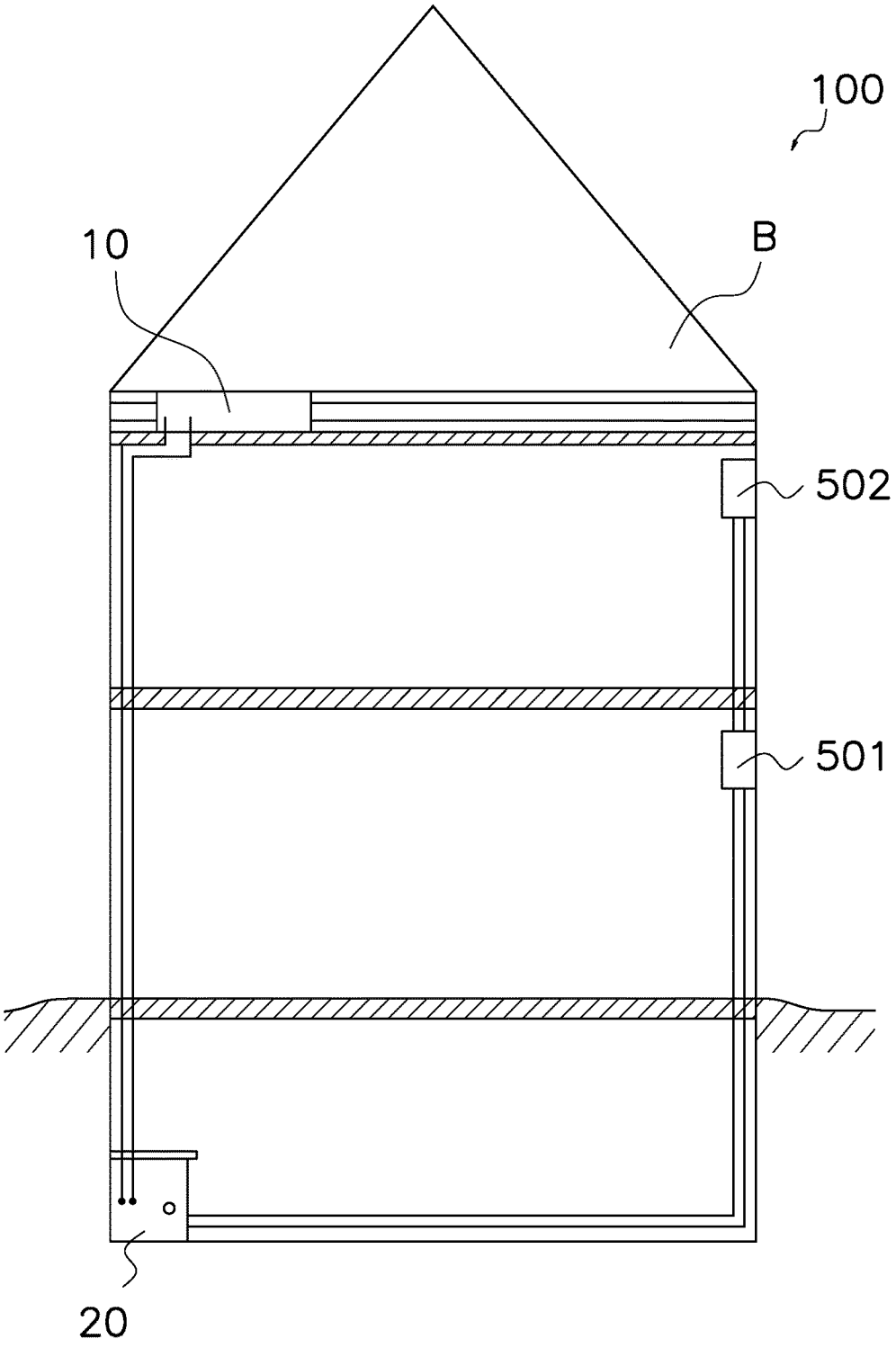
FIG. 5 is a schematic view of the refrigeration apparatus 100 according to a modification example 1B of the first embodiment.

The heat source heat exchanger unit 10 according to the above embodiment is disposed outside the building B. The heat source heat exchanger unit 10 may alternatively be disposed inside the building B and be fluid connected to an outside of the building B. As exemplarily depicted in FIG. 5, the heat source heat exchanger unit 10 may be disposed at a duct provided to the building B. The duct is fluid connected to the outside of the building B, and sends and receives air to and from outside the building B.

This configuration does not affect quality in outer appearance of the building B.

(6-3) Modification Example 1C

The above embodiment provides two utilization units, namely, the utilization units 501 and 502. The number of the utilization units may alternatively be other than two. For example, the number of the utilization units may be one, three, or four.

Second Embodiment

(1) CONFIGURATION

Figure 6:
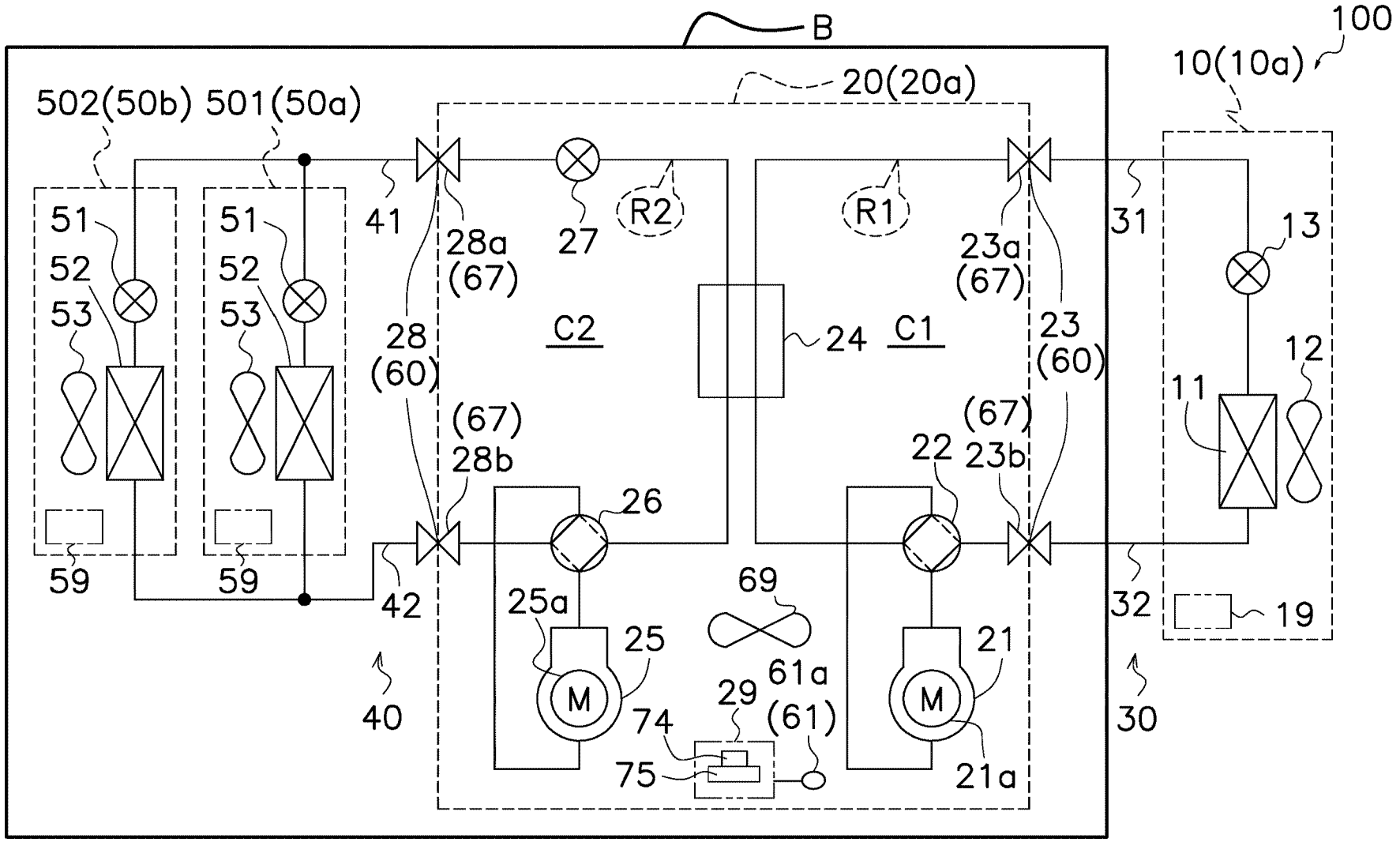
FIG. 6 is a circuit diagram of a refrigeration apparatus 100 according to a second embodiment.

FIG. 6 is a circuit diagram of a refrigeration apparatus 100 according to the second embodiment. Unlike the first embodiment, the refrigeration apparatus 100 includes a cascade heat exchanger 24 and entirely constitutes two refrigerant cycles.

The first refrigerant cycle C1 causes circulation of the first refrigerant R1. The first refrigerant R1 preferably has a low global warming potential (GWP) value. Examples of the first refrigerant R1 include R32 and carbon dioxide. The first refrigerant cycle C1 adopts the heat source heat exchanger 11 as a heat source. The first refrigerant cycle C1 is constituted by components such as the first compressor 21, the first four-way switching valve 22, the first gas side shutoff valve 23*b*, the heat source heat exchanger 11, the heat source heat exchanger unit expansion valve 13, the first liquid side shutoff valve 23*a*, and the cascade heat exchanger 24.

The second refrigerant cycle C2 causes circulation of the second refrigerant R2. The second refrigerant R2 preferably has a low GWP value. Examples of the second refrigerant R2 include R410A, R32, and carbon dioxide. The second refrigerant cycle C2 adopts the cascade heat exchanger 24 as a heat source. The second refrigerant cycle C2 is constituted by components such as a second compressor 25, a second four-way switching valve 26, the cascade heat exchanger 24, a compressor unit expansion valve 27, the utilization unit expansion valve 51, the utilization heat exchanger 52, and the first gas side shutoff valve 23*b*.

(2) CHARACTERISTICS

Also in this configuration, the shutoff valve 67 can shut off the first connection piping 30 and the second connection piping 40 extending from the compressor unit 20. When the refrigerant R0 leaks in the compressor unit 20, this configuration can thus inhibit the leaking refrigerant R0 from reaching outside the compressor unit 20.

(3) MODIFICATION EXAMPLES

(3-1) Modification Example 2A

Figure 7:
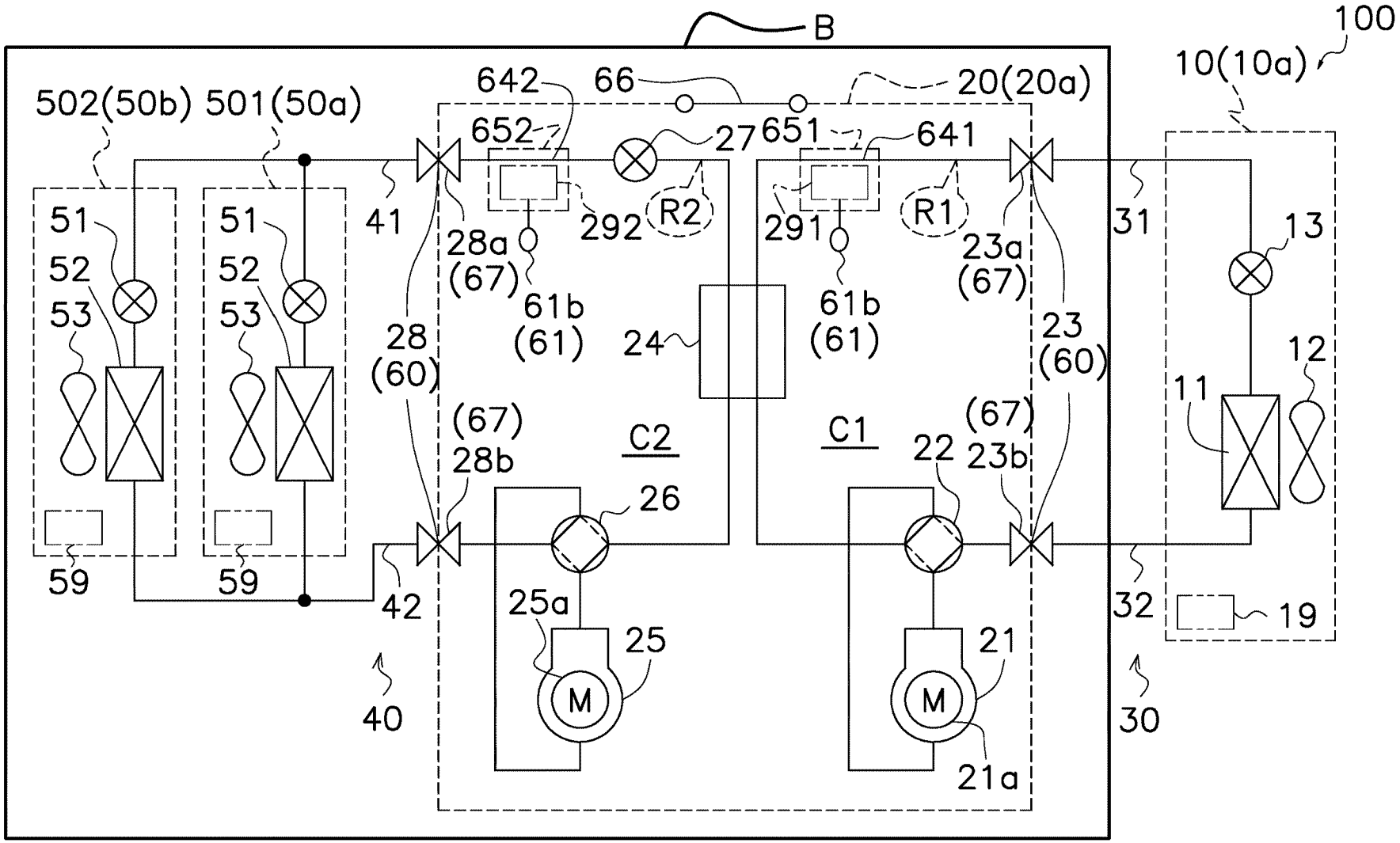
FIG. 7 is a circuit diagram of the refrigeration apparatus 100 according to a modification example 2A of the second embodiment.

FIG. 7 depicts the refrigeration apparatus 100 according to the modification example 2A of the second embodiment. Unlike the above embodiment, the refrigeration apparatus 100 includes compressor unit control units 291 and 292 that are cooled by cooling refrigerant pipes 641 and 642 via refrigerant jackets 651 and 652, respectively. Furthermore, the case 20*a* of the compressor unit 20 has airtightness. The leakage detection sensor 61 is the pressure sensor 61*b*. The case 20*a* is provided with a rupture disk 66. The rupture disk 66 is destroyed by pressure exceeding a predetermined value.

In this configuration, the case 20*a* of the compressor unit 20 has airtightness, so that the case 20*a* is likely to contain heat generated by a circuit board. However, the cooling refrigerant pipes 641 and 642 can achieve effective release of heat generated by circuit boards constituting the compressor unit control units 291 and 292, respectively. Alternatively, cooling of the circuit boards may be achieved by disposing the compressor unit control unit 29 outside the case 20*a*, instead of the cooling refrigerant pipes 641 and 642. Still alternatively, cooling of the circuit boards may be achieved when a fan configured to generate a circulation air flow is adopted instead of the cooling refrigerant pipes 641 and 642.

Furthermore, the case 20*a* has airtightness to inhibit the refrigerant R0 leaking in the compressor unit 20 from reaching outside the compressor unit 20.

Furthermore, the leakage detection sensor 61 is the pressure sensor 61*b* to detect leakage of the refrigerant R0 in accordance with pressure change.

Furthermore, the case 20*a* includes the rupture disk 66, so that the case 20*a* having high airtightness can be inhibited from being ruptured by high internal pressure.

Moreover, the case 20*a* having airtightness can inhibit noise of the compressor unit 20.

The case 20*a* achieves a higher electromagnetic noise cutoff effect when the case 20*a* is made of a metal.

(3-2) Modification Example 2B

Any one of the modification examples of the first embodiment may be applied to the second embodiment.

Third Embodiment (1) CONFIGURATION

Figure 8:
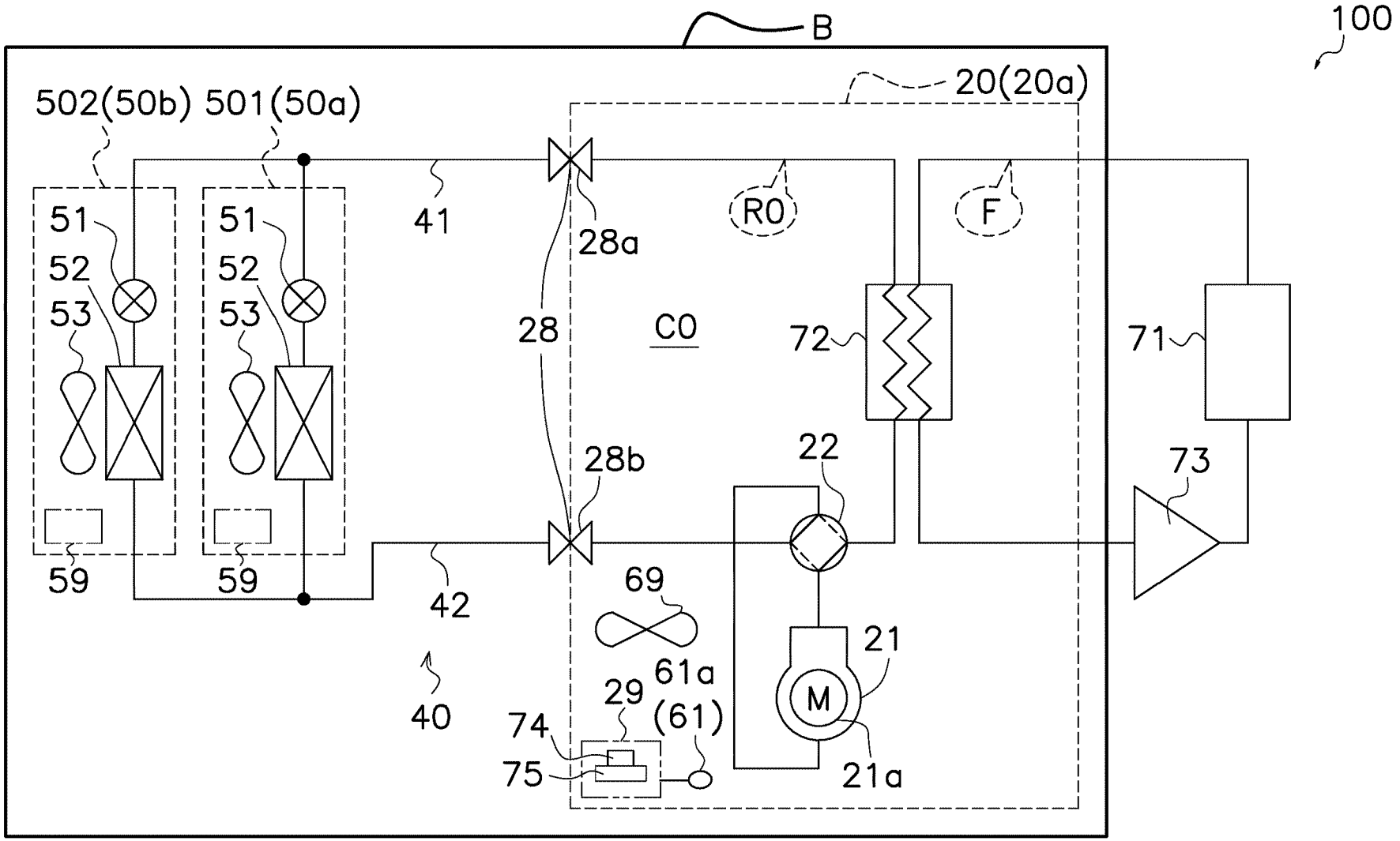
FIG. 8 is a circuit diagram of a refrigeration apparatus 100 according to a third embodiment.

FIG. 8 is a circuit diagram of a refrigeration apparatus 100 according to the third embodiment. Unlike the first embodiment, the refrigeration apparatus 100 includes a heat source 71, a fluid-refrigerant heat exchanger 72, and a pump 73. The heat source 71 is disposed outside the building B. The fluid-refrigerant heat exchanger 72 and the pump 73 are provided at the compressor unit 20.

The heat source 71, the fluid-refrigerant heat exchanger 72, and the pump 73 constitute a circuit configured to circulate fluid F such as water or brine.

The refrigerant cycle C0 causes circulation of the refrigerant R0. The refrigerant cycle C0 adopts the fluid-refrigerant heat exchanger 72 as a heat source. The fluid-refrigerant heat exchanger 72 exchanges heat between the fluid F and the refrigerant R0.

The compressor unit 20 includes the second liquid side shutoff valve 28*a* and the second gas side shutoff valve 28*b* disposed at the second connecting port 28.

(2) CHARACTERISTICS

In this configuration, the second connection piping 40 extending from the compressor unit 20 can be shut off by the second liquid side shutoff valve 28*a* and the second gas side shutoff valve 28*b*. When the refrigerant R0 leaks in the compressor unit 20, this configuration can thus inhibit the leaking refrigerant R0 from reaching outside the compressor unit 20.

(3) MODIFICATION EXAMPLES

Any one of the modification examples of the first or second embodiment may be applied to the third embodiment.

CONCLUSION

The embodiments of the present disclosure have been described above. Various modifications to modes and details should be available without departing from the object and the scope of the present disclosure recited in the claims.

REFERENCE SIGNS LIST

10: heat source heat exchanger unit
10*a*: case (second case)
11: heat source heat exchanger
20: compressor unit
20*a*: case (first case)
21: compressor
23: first connecting port
23*a*: first liquid side shutoff valve (first shutoff valve)
23*b*: first gas side shutoff valve (first shutoff valve)
28: second connecting port
28*a*: second liquid side shutoff valve (second shutoff valve) (shutoff valve)
28*b*: second gas side shutoff valve (second shutoff valve) (shutoff valve)
29: compressor unit control unit (control unit)
30: first connection piping
40: second connection piping (connection pipe)
50*a*: case (third case)
50*b*: case
52: utilization heat exchanger
60: connecting port
61: leakage detection sensor
61*a*: refrigerant detection sensor
61*b*: pressure sensor
64: cooling refrigerant pipe
66: rupture disk
67: shutoff valve
69: fan
72: fluid-refrigerant heat exchanger
74: electrical component
75: heat sink
100: refrigeration apparatus
501: utilization unit
502: utilization unit
B: building
C0: refrigerant cycle
C1: first refrigerant cycle (refrigerant cycle)
C2: second refrigerant cycle (refrigerant cycle)
F: fluid
R0: refrigerant
R1: first refrigerant (refrigerant)
R2: second refrigerant (refrigerant)

CITATION LIST

Patent Literature

Patent Literature 1: Japanese Patent Application Laid-Open Publication No. 2018-511771

The invention claimed is:

1. A compressor unit comprising:
a first case;
a compressor accommodated in the first case;
a connecting port including a first liquid connecting port, a first gas connecting port, a second liquid connecting port, and a second gas connecting port;
a shutoff valve including a first liquid shutoff valve, a first gas shutoff value, a second liquid shutoff value and a second gas shutoff valve;
a leakage detection sensor accommodated in the first case and configured to detect leakage of the refrigerant; and
a controller configured to close the first liquid shut off value, the first gas shutoff valve, the second liquid shutoff valve, and the second gas shutoff valve, when the leakage detection sensor detects leakage of the refrigerant,
wherein
the compressor, a heat source heat exchanger, and a utilization heat exchanger constitute a refrigerant cycle adopting the heat source heat exchanger as a heat source and configured to cause circulation of a refrigerant,
the heat source heat exchanger is accommodated in a second case provided separately from the first case, the utilization heat exchanger is accommodated in a third case provided separately from the first case, the compressor unit is disposed inside a building, the first connecting port is connected to the heat source heat exchanger via a first connection piping, the second connecting port is connected to the utilization heat exchanger via a second connection piping, the controller is configured to shut the first liquid shutoff valve and the first gas shutoff valve so that the first liquid shutoff valve and the first gas shutoff valve shut off flow of the refrigerant between the first connecting port and the heat source heat exchanger, and the controller is configured to shut the second liquid shutoff valve and the second gas shutoff valve so that the second liquid shutoff valve and the second gas shutoff valve shut off flow of the refrigerant between the second connecting port and the utilization heat exchanger.

2. A compressor unit comprising:

a first case;

a compressor accommodated in the first case;

a fluid-refrigerant heat exchanger accommodated in the first case and configured to exchange heat between fluid and a refrigerant;

a connecting port;

a shutoff valve including a liquid shutoff valve and a gas shutoff valve;

a leakage detection sensor accommodated in the first case and configured to detect leakage of the refrigerant; and a controller configured to close the liquid shutoff valve and the gas shutoff valve when the leakage detection sensor detects leakage of the refrigerant, wherein the compressor, the fluid-refrigerant heat exchanger, and a utilization heat exchanger constitute a refrigerant cycle adopting the fluid-refrigerant heat exchanger as a heat source and configured to cause circulation of the refrigerant, the utilization heat exchanger is accommodated in a second case provided separately from the first case, the compressor unit is disposed inside a building, the connecting port is connected to the utilization heat exchanger via a connection piping, and the controller is configured to shut the liquid shutoff valve and the gas shutoff valve so that the liquid shut off valve and the gas shutoff valve shut off flow of the refrigerant between the connecting port and the utilization heat exchanger.

3. The compressor unit according to claim 1, wherein the controller is disposed outside the first case.

4. The compressor unit according to claim 1, further comprising a cooling refrigerant pipe accommodated in the first case, wherein the controller is disposed inside the first case and is cooled by the cooling refrigerant pipe.

5. The compressor unit according to claim 1, further comprising:

an electrical component accommodated in the first case;

a heat sink accommodated in the first case and configured to cool the electrical component; and a fan accommodated in the first case and configured to form a circulation air flow, wherein the controller is disposed inside the first case and is cooled by the circulation air flow.

6. The compressor unit according to claim 1, wherein the leakage detection sensor is a refrigerant detection sensor configured to detect presence of the refrigerant.

7. The compressor unit according to claim 1, wherein the first case has airtightness.

8. The compressor unit according to claim 7, wherein the leakage detection sensor is a pressure sensor configured to detect pressure in the first case.

9. The compressor unit according to claim 7, wherein the first case includes a rupture disk destroyed by pressure exceeding a predetermined value.

10. The compressor unit according to claim 1, wherein the refrigerant is R32 or carbon dioxide.

11. A refrigeration apparatus comprising:

the compressor unit according to claim 1;

a heat source heat exchanger unit including a second case and the heat source heat exchanger; and a utilization unit including a third case and the utilization heat exchanger, wherein the heat source heat exchanger unit is disposed inside the building and is fluid connected to an outside of the building.

12. The compressor unit according to claim 2, further comprising a leakage detection sensor accommodated in the first case and configured to detect leakage of the refrigerant.

13. The compressor unit according to claim 3, wherein the leakage detection sensor is a refrigerant detection sensor configured to detect presence of the refrigerant.

14. The compressor unit according to claim 4, wherein the leakage detection sensor is a refrigerant detection sensor configured to detect presence of the refrigerant.

15. The compressor unit according to claim 5, wherein the leakage detection sensor is a refrigerant detection sensor configured to detect presence of the refrigerant.

16. The compressor unit according to claim 3, wherein the first case has airtightness.

* * * * *